United States Patent [19]

Kesselring et al.

[11] Patent Number: 4,526,274

[45] Date of Patent: Jul. 2, 1985

[54] FEEDING TEAT, OPENING INSTRUMENT AND HOLDER

[75] Inventors: Lutz Kesselring; Horst Frödrich, both of Zeven, Fed. Rep. of Germany

[73] Assignee: MAPA GmbH Gummi-und Plastikwerke, Zeven, Fed. Rep. of Germany

[21] Appl. No.: 525,750

[22] Filed: Aug. 23, 1983

[30] Foreign Application Priority Data

Aug. 24, 1982 [DE] Fed. Rep. of Germany ..... 3231381

[51] Int. Cl.[3] ..... A61J 9/00

[52] U.S. Cl. ..... 206/231; 215/11 R

[58] Field of Search ..... 215/11 B, 11 R, 11 C, 215/11 D; 206/217, 229, 223, 216, 231

[56] References Cited

U.S. PATENT DOCUMENTS

| | | | |
|---|---|---|---|
| 1,146,639 | 7/1915 | Miller | 215/11 B |
| 2,680,441 | 6/1954 | Krammer | 215/11 R X |
| 3,373,864 | 3/1968 | Barton et al. | 215/11 C X |

*Primary Examiner*—Donald F. Norton

*Attorney, Agent, or Firm*—Toren, McGeady, Stanger

[57] ABSTRACT

A feeding teat comprises a tip portion and a lower opening for connection to a container and is formed with an external recess, which is substantially wedge-shaped in cross-section and closed from the interior of the teat and constitutes a guide for an opening instrument. Such feeding teat and an opening instrument are held in a common holder. The common holder may consist of a cover and may be provided near one open end of the cover with clipping means for retaining the opening instrument.

12 Claims, 11 Drawing Figures

FEEDING TEAT, OPENING INSTRUMENT AND HOLDER

SUMMARY OF THE INVENTION

This invention relates to a feeding teat which comprises a tip portion that is formed with a drinking opening and joined to a tapered portion of a shaft for connecting the teat to a container. The teat is formed particularly in the tapered portion of the shaft with an external recess which is substantially wedge-shaped in cross-section.

The invention relates also to an assembly which includes such feeding teat. Such assembly may constitute a package comprising a bottle and the feeding teat. The invention also relates to an assembly which comprises the feeding teat and a cover in which the teat is retained. Such cover may be detachably mounted on a bottle, which is provided with the teat, or may constitute a portion of a teat container, which has an opening defined by a raised rim, which has external screw threads in threaded engagement with a cover cup by which the flange of a teat fitted on said rim is clamped down against the bottom of the container.

In such an assembly comprising a bottle, the same may have special profiled portions.

In a feeding teat of the kind described first hereinbefore and known from U.S. Pat. No. 1,146,639, the wedge-shaped recess is continued by a slit, which communicates with the interior of the teat and constitutes an air-admitting opening.

Air-admitting openings are desirable in order to prevent an inversion of the teat. Such inversion will depend on the vacuum inside the teat, on the consistency of food to be dispensed in relation to the size of the drinking opening, and on the ability of the infant to exert any suction force. Infant food may consist of highly fluid tea or milk or of a more or less thickened pap and these kinds of food are fed to the infant at different ages. It is also desired to compel the infant to exert a uniform effort as it sucks an appropriate food through the drinking opening. Under certain circumstances an admission of air may not be required at all.

The above-mentioned teat disclosed in U.S. Pat. No. 1,146,639, which has been mentioned only by way of example, cannot be adapted to clamping conditions and always provides the same conditions regarding the drinking opening and the inlet opening of the teat. If different conditions are to be provided in view of the above requirements, that known teat will not be satisfactory in use.

It is an object of the invention to provide a feeding teat which is of the kind described first hereinbefore and which is adaptable to changing conditions required as the infant grows, and also to provide an assembly including such teat.

In such feeding teat, that object is accomplished in accordance with the invention in that the recess is closed from the interior of the teat and constitutes a guide for an opening instrument. The resulting feeding teat can be described as a valved teat and in addition to the inlet and drinking openings has no further opening but only a recess which is closed on the inside.

When the buyer of the teat, usually the mother of an infant, is instructed to form in the teat a drinking opening and to pierce the wall of the teat at a second location, the provision of a satisfactory air-admitting opening is usually not ensured. This is due to the fact, in the first place, that such piercing is effected from the outside to the inside of the teat wall and owing to the resiliency of the teat material is virtually unsuitable for breathing. The above-mentioned recess will facilitate the provision of an air-admitting opening. Its main function is to guide an opening instrument, which is engageable with side wall portions defining the recess. The opening instrument may consist of a needle or a pointed knife. The guiding recess does not serve only to indicate the location at which a valve opening is to be provided in the substantially wedge-shaped recess but also ensures that such instrument will be so guided and aligned, e.g., by friction at an edge, that the valve opening will be formed at a predetermined location.

The valve action can be desirably ensured in that the recess extends into the wall of the teat to a depth of about two-thirds of the thickness of the teat wall. In a preferred embodiment the wedge-shaped recess is slot-shaped. A slot provides a guidance not only between its side walls but also in its longitudinal direction. From this aspct the bottom of the slot-shaped recess slopes radially inwardly toward the center of its lengths and the remaining teat wall has a smaller thickness adjacent to the center of the length of the recess than at adjacent regions of the recess. In that case a pointed knife can be used to form a slot of predetermined size even when a minute opening for initial milk has previously been formed by a prick with a needle. Thereafter, the feeding of more viscous food can be facilitated in that a knifelike instrument is inserted through and guided by the slot-shaped recess so that a flap valve can gradually be formed at the initially closed recess.

It is apparent that a feeding teat of the kind described, which has a recess that is initially closed from the interior of the teat, is a highly desirable feeding teat.

In a particularly preferred embodiment, that recess is provided in a preferably spherical depression formed in the teat wall, particularly in the tapered portion of the shaft. As a result, a through opening which is subsequently formed will permit of breathing in a particularly desirable manner, regardless of the size of such opening. This fact constitutes a substantial improvement over the above-mentioned prior art, in which the teat is inherently provided with an air-admitting slot and with thinner edge portions adjacent to said slot.

The assembly including the feeding teat comprises a common holder for the teat and for an instrument. In such an assembly the teat provided with the recess and the instrument for forming a through opening in the recess are held by a common part so that the teat and the instrument are available and the opening instrument is retained in the assembly. As a result, the opening instrument is available for use and permits the user of the teat to form the through opening as is required. The guidance for the opening instrument ensures that the size of the through opening can be controlled. Thus, the assembly provides a suitable opening instrument.

If the through hole of controlled size is to be enlarged as the infant becomes older or in dependence on the consistency of the feed, the assembly will always make available a suitable opening instrument, which can be exactly guided to form an opening which has a proper size in view of the age of the infant and in view of the increasing consistency of the food which is required.

If the holder consists of a cover, the latter may be provided with clipping means for retaining the opening instrument near one open end of the cover in such a position that a handle of the opening instrument is accessible at the rim of the open cover. Such assembly will promote the selling also of the bottle.

If the cover comprises a socket member, elevated seating means for supporting the flange of the teat may be provided on the bottom of the socket member and may serve to retain the opening instrument, which is adapted to be removed in an upward direction. This is another desirable feature of the assembly.

From this aspect the invention includes also a wrapper which is adapted to be applied around a bottle and includes a tubular receptacle for a removable opening instrument. When this wrapper is used in combination with a bottle, the latter is suitably provided in its wall with one or more recesses for receiving the wrapper and/or a tubular receptacle for retaining an opening instrument. From this aspect the invention includes also a bottle having a special profiled portion.

The opening instrument desirably comprises a needle, which tapers conically to its point, and a handle carrying the needle. In an other desirable embodiment the opening instrument consists of a knife, which comprises a handle and a pointed blade, which has a knife edge extending at an acute angle to its longitudinal direction. Such knife edge may extend throughout the width of the opening instrument or the blade may be wedge-shaped. This will ensure a particularly effective guidance of the instrument. The provision of an opening instrument consisting of a handle and a tool facilitates the retaining of the instrument on a holder also for other purposes, for supporting the instrument in the assembly, and permits the instrument to be clipped in position.

The teat which has been described is preferably made from silicon elastomers and may be made as molded teat. That process of manufacturing the teat under high pressure permits the teat to be designed with a small wall thickness so that the recess provided in preparation of a through opening can be made with higher accuracy.

BRIEF DESCRIPTION OF THE DRAWING

The invention will now be explained with reference to illustrative embodiments which are shown on the drawing, in which.

DETAILED DESCRIPTION OF THE INVENTION

Figure 1:
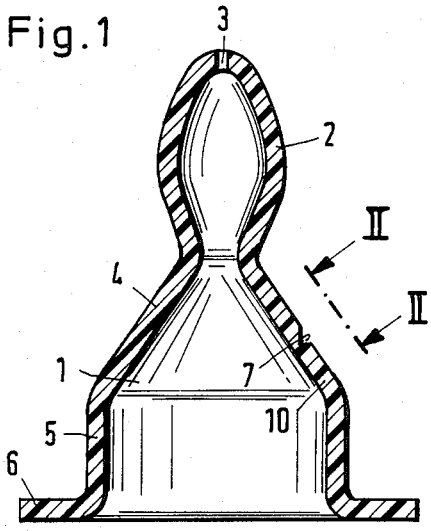
FIG. 1 is a diagrammatical vertical sectional view showing a feeding teat.

In all figures of the drawing, like parts are designated with the same reference characters.

The feeding teat 1 comprises a tip portion 2 formed with a drinking opening 3 and adjoining by a tapered tubular portion 4 of a shaft 5, which may be provided with a flange 6 and is adapted to be fitted on a container, particularly on a bottle.

Figure 2:
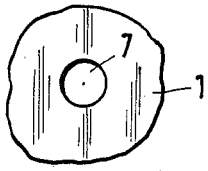
FIG. 2 is a top plan view on the portion II indicated in FIG. 1.

That feeding teat is provided with an external recess 7, which is also shown in a fragmentary view in FIG. 2. That recess is externally open and closed from the interior of the teat and has a depth corresponding to about two-thirds of the thickness of the teat wall. In the embodiment shown in FIG. 2, the recess 7 is circular. FIG. 1 shows that the recess is wedge-shaped in cross-section.

Figure 3:
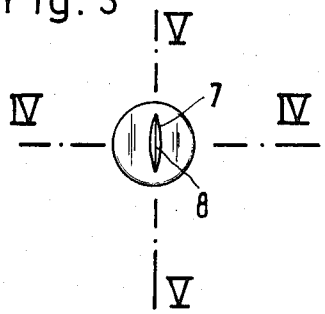
FIG. 3 is a top plan view which is similar to FIG. 2 and shows a different recess.

In the embodiment shown in FIG. 3 the recess has the shape of an elongated slot 8, which extends, e.g., along the longitudinal axis of the teat 1. Alternatively, the slot may extend across said longitudinal axis; that design may also be adopted for the recess 7 shown in FIG. 1 . The provision of a recess extending along the axis of the teat, as shown in FIG. 3, affords the advantage that when a slitlike through opening has been formed through the bottom of the recess 7 the breathing will be favorably influenced by the tapered shaft portion 4, which has a curved or other shape.

Figure 4:
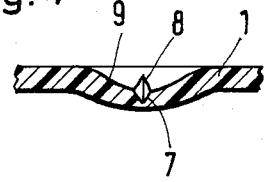
FIG. 4 is a sectional view taken on line IV—IV in FIG. 3 and showing a specially shaped teat wall.

In accordance with FIG. 4 the recess 7 is formed in a depression 9 formed in the outside peripheral surface of the teat 1, in which the side wall designated 10 in FIG. 1 has a spherical depression.

Figure 5:
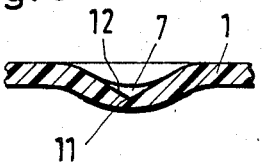
FIG. 5 is a fragmentary sectional view taken on line V—V in FIG. 3 and showing a portion of the teat wall.

In FIG. 5 the depression 9 is shown in a cross-sectional view which differs from that of FIG. 4 and it is apparent that the wedge-shaped recess 7 constitutes a slot 8 and conforms to the curvature of the teat wall but initially does not extend through the teat wall. It is also apparent that the bottom 12 of the recess 7 is formed with a groove 11, which has in cross-section the shape of an obtuse-angled V and serves to guide an opening instrument, which may consist of a needle or a pointed knife so that the control of the size of an air-admitting opening will be facilitated.

Figure 6:
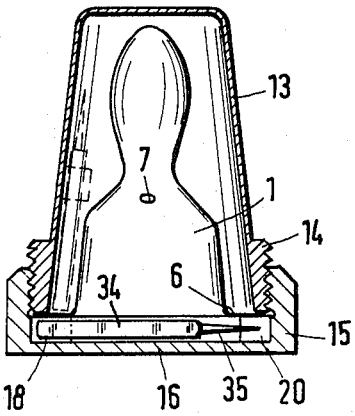
FIG. 6 is a vertical sectional view showing an assembly including a feeding teat and special means for retaining an opening instrument.
Figure 7:
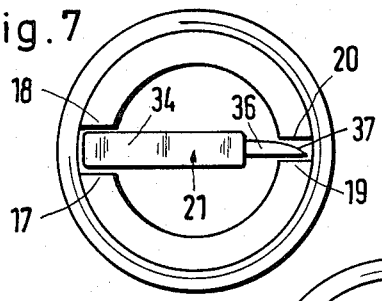
FIG. 7 is a top plan view showing a socket member as illustrated in FIG. 7.
Figure 7A:
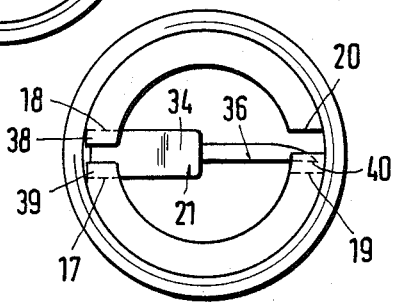
FIG. 7*a* is a fragmentary view illustrating a modification of a portion of the socket member of FIG. 7.
Figure 10:
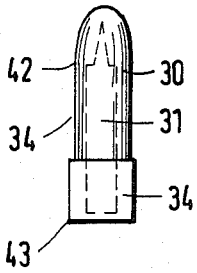
FIG. 10 is an elevation showing a tubular receptacle of the assembly of FIG. 9.

FIGS. 6 and 7 show an assembly in the form of a package including a feeding teat 1 as described hereinbefore, which has a flange 6 and a recess 7. The flange 6 is gripped between a cover cup 13, which has external screw threads 14, and a socket member 15, which has been screwed on the screw threads 14 and is provided on its bottom 16 with elevated seating portions 17, 18, 19, 20 by which the flange 6 is engaged on the underside so that it will be surrounded by the cover cup 13 when the same has been screwed into the socket member 15. The elevated seating portions 17 to 20 on the bottom 16 of the socket member serve to retain an opening instrument in a predetermined orientation and may be provided with projections which can overlie the opening instrument and clip the same in position even when the cover cup 13 has been screwed out of the socket member 15. Said overlying projections at the ends of the elevated seating portions 17 to 19 are indicated at 38 to 40 in FIG. 7*a* and may consist of resilient projections which present only a small resistance to the insertion and removal of the opening instrument.

Figure 8:
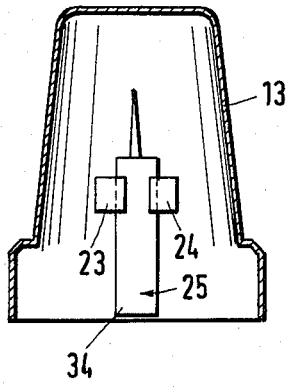
FIG. 8 is a diagrammatic vertical sectional view showing a cover provided with an opening instrument.

FIG. 8 shows a different embodiment including a cover cup 13. This embodiment is also indicated in FIG. 6 by dotted lines at 22. It is apparent from FIG. 8 that said other embodiment comprises two clipping lugs 23, 24, which overlie the opening instrument 25 and detachably retain it on the inside surface of the cover cup 13 so that the handle 34 of the opening instrument is accessible to the fingers reaching through the bottom opening of the cover cup.

The opening instrument may alternatively be arranged on the outside although its arrangement on the inside of the cover cup 13 will be preferred. The clipping projections 23, 24 consist of spring clips and are secured to the wall of the cover cup 13. Said extensions have confronting ends which are spaced apart and may be curved upwardly so that the opening instrument 21 can be removed and re-inserted in conjunction with a spreading of the clipping extensions 23, 24. That removal and re-insertion may be facilitated by the provision of the opening instrument with a handle 34 which is oval in cross-section and can be rotated as the instrument is inserted and removed.

Figure 9:
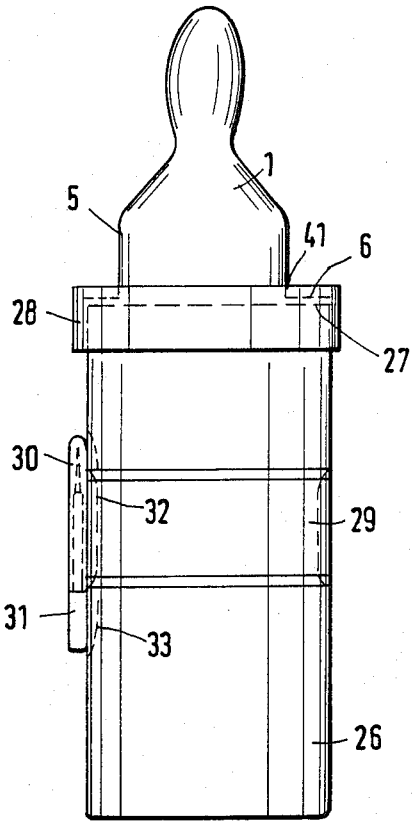
FIG. 9 is a diagrammatic side elevation showing a combination of a bottle and a teat.

FIG. 9 shows an assembly including a bottle 26, the opening of which is surrounded by an annular rim 27, on which a flange 6 of a feeding teat 1 is held by means of a cap nut 28. The cap nut 28 has a central opening 41, through which the shaft 5 of the teat extends. The flange 6 is held between the rim 27 and the annular top wall of the cap nut 28 beside the opening 41. A wrapper 29 has been applied around the bottle 26 and comprises a tubular receptacle 30 for an opening instrument 31, which is adapted to be removed against spring action. The wrapper 29 may consist of a strap, a resilient loop or a spring clip, which is closed adjacent to the tubular receptacle 30. Two arcuate spring legs, which are adapted to be spread apart, extend from the tubular receptacle around the bottle. The wall of the bottle 26 is formed in its outside surface with a recess 32, into which the wrapper 29 extends. Thus the invention provides also a bottle having a correspondingly recessed wall. Said recess 32 receives and fits the spring legs or the strap of the wrapper 29. The wall of the bottle 26 may be formed in its outside surface with another recess 33 for receiving the tubular receptacle 30. As shown in FIG. 9 that recess 33 extends parallel to the longitudinal axis of the bottle and the tubular receptacle is provided with means for clipping an opening instrument 31 in position.

The tubular receptacle 30 is telescopic and includes a body 42, which is secured, e.g., to the wrapper 29, and a clamping cap 43, which is slidably fitted on the body 42. The clamping cap will be held in position when the tubular receptacle is held in the mating recess 33 of the bottle wall by the wrapper 29, which is resilient to permit the tubular receptacle to be removed from the recess 33.

The opening instrument, such as 21, has a handle 34 and a pointed knife blade 35, as is shown in FIG. 6. Such a pointed knife can be inserted in a controlled manner and can be guided by the recess 7. In accordance with FIG. 7 the pointed knife 36 has a knife edge 37 that extends at an acute angle to the longitudinal direction of the knife.

On the specially designed bottle 26 having recesses in its outside surface, the wrapper is desirably held so as to be detachable when the bottle is to be used. For this purpose the wrapper may comprise a strap provided with a fastener or a spring clip.

What is claimed is:

1. An assembly comprising a feeding teat, an opening instrument, and a holder for said feeding teat and said opening instrument, said feeding teat comprising a tip portion, which is formed on the outside with a recess that is substantially wedge-shaped in cross-section and closed from the interior of the teat and constitutes means for guiding said opening instrument, said holder comprising first retaining means for detachably retaining said teat on said holder and second retaining means for detachably retaining said opening instrument on said holder.

2. An assembly as set forth in claim 1, wherein said holder comprises a socket member and a cover cup detachably connected to said socket member and containing said teat.

3. An assembly as set forth in claim 2, wherein said opening instrument comprises a handle and said second retaining means comprise clipping means for detachably retaining said opening instrument in said cover cup in a position in which said handle is disposed near the opening of said cover cup.

4. An assembly as set forth in claim 2, wherein said socket member has a bottom formed on its upper surface with elevated seating means and has a raised rim having a profiled inside surface, said cover cup has a profiled outside surface, which fits said profiled inside surface, and has an end rim which defines an opening and faces and is closely spaced from said seating means, said teat has a shaft with an external annular flange, which is remote from said tip portion and held between said rim of said cover cup and said seating means, said opening instrument has a handle and said second retaining means comprise clipping means provided on the inside peripheral surface of said cover cup and detachably retaining said opening instrument in said cover cup so that said handle is close to said rim of said cover cup.

5. An assembly as set forth in claim 2, wherein said socket member has a bottom formed on its upper surface with elevated seating means and has a raised rim having a profiled inside surface, said cover cup has a profiled outside surface, which fits said profiled inside surface, and has an end rim which defines an opening and faces and is closely spaced from said seating means, said teat has a shaft with an external annular flange, which is remote from said tip portion and held between said rim of said cover cup and said seating means, said seating means define two gaps which are spaced apart on said bottom, said opening instrument extends in said gaps, and said second retaining means are carried by said seating means and detachably retain said opening instrument in said gaps.

6. An assembly as set forth in claim 5, wherein said second retaining means comprise clipping means which are carried by and project from said seating means over said gaps.

7. An assembly as set forth in claim 1, wherein said holder comprises a bottle.

8. An assembly as set forth in claim 1, wherein said opening instrument comprises a handle and a needle which is secured to said handle and tapers from said handle to a pointed tip.

9. An assembly as set forth in claim 1, wherein said opening instrument comprises a handle and a pointed knife blade which is secured to said handle and has a knife edge which includes an acute angle with the longitudinal direction of said blade.

10. An assembly as set forth in claim 1, wherein said wedge-shaped recess is slot-shaped.

11. An assembly as set forth in claim 1, wherein said recess is formed in a depression formed in the outside peripheral surface of said teat.

12. An assembly as set forth in claim 1, wherein said teat has a shaft extending from said tip portion and said shaft has a portion which tapers toward and adjoins said tip portion, and said recess is formed in said tapered portion.

* * * * *